US006802660B2

(12) United States Patent
Koblinger

(10) Patent No.: US 6,802,660 B2
(45) Date of Patent: Oct. 12, 2004

(54) PRINTING DEVICE

(75) Inventor: Michael Koblinger, Kolitzheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/416,159

(22) PCT Filed: Oct. 15, 2001

(86) PCT No.: PCT/DE01/03942

§ 371 (c)(1),
(2), (4) Date: May 15, 2003

(87) PCT Pub. No.: WO02/40277

PCT Pub. Date: May 23, 2002

(65) Prior Publication Data

US 2004/0028443 A1 Feb. 12, 2004

(30) Foreign Application Priority Data

Nov. 17, 2000 (DE) ..... 100 57 063

(51) Int. Cl.[7] ..... B41J 2/145

(52) U.S. Cl. ..... 400/283; 400/319; 347/37; 347/40

(58) Field of Search ..... 347/20, 37, 38, 347/39, 40; 400/55, 283, 319, 327, 353; 101/463.1, 477

(56) References Cited

U.S. PATENT DOCUMENTS

| | | | | |
|---|---|---|---|---|
| 4,864,328 | A | | 9/1989 | Fischbeck |
| 5,428,375 | A | * | 6/1995 | Simon et al. ..... 347/12 |
| 5,771,054 | A | * | 6/1998 | Dudek et al. ..... 347/102 |
| 6,154,232 | A | | 11/2000 | Hickman et al. |
| 6,183,063 | B1 | | 2/2001 | Bolash et al. |
| 6,234,605 | B1 | * | 5/2001 | Hilton ..... 347/42 |
| 6,332,665 | B1 | * | 12/2001 | Mantell et al. ..... 347/37 |
| 6,457,800 | B1 | * | 10/2002 | Bohm et al. ..... 347/19 |
| 6,593,953 | B1 | * | 7/2003 | Ross et al. ..... 347/221 |
| 6,612,672 | B2 | * | 9/2003 | Yasuda ..... 347/12 |
| 6,652,088 | B1 | * | 11/2003 | Palmer et al. ..... 347/103 |

FOREIGN PATENT DOCUMENTS

| | | |
|---|---|---|
| EP | 1 033 254 A2 | 9/2000 |
| GB | 2 349 607 A | 1/2000 |

* cited by examiner

*Primary Examiner*—Andrew H. Hirshfeld
*Assistant Examiner*—Dave A Ghatt
(74) *Attorney, Agent, or Firm*—Jones, Tullar & Cooper PC

(57) ABSTRACT

ABSTRACT OF THE DISCLOSURE A printing device is usable to print a material which is bent around a printing cylinder. The printing device includes a plurality of print heads and a print head holder. The print head holder positions the print heads in a common holder plane which is defined by the holder. The print heads are disposed in a row that is inclined relative to the printing device at an acute angle. The print heads are also inclined relative to the holder plane so that they are directed at substantially a right angle to the material to be printed.

10 Claims, 4 Drawing Sheets

PRINTING DEVICE

FIELD OF THE INVENTION

The present invention is directed to a printing device. The printing device is particularly usable to print materials that are curved around a printing cylinder.

BACKGROUND OF THE INVENTION

The present invention is directed to a printing device that is usable for imprinting material to be imprinted, which material is curved around a printing cylinder. The printing device has a plurality of print heads and a print head holder, which holder is used for seating the print heads on a holding plane defined by the print head holder. The print heads are arranged along the print head holder in a row which extends at an acute angle in respect to the printing direction.

"Printing direction" in this context means the running direction of the material to be imprinted in relation to the print heads. If the material to be imprinted travels around or wraps around the printing cylinder, the printing direction extends perpendicularly in relation to the axis of rotation of the printing cylinder.

As a rule, ink jet printers operate with two print heads, namely with one print head for color printing and with one print head for black printing. A movement along two axes takes place between the material to be imprinted and the print heads. The material to be imprinted is moved in the printing direction, and the print heads are moved transversely to this, so that the image points can be exactly aligned with each other by utilization of a chronological control of the shot times. As a rule, printing of flat material takes place, so that positional deviations of the individual image points in respect to their neighboring image points are small, and accordingly there is also only a slight distortion of the printed image.

However, the disadvantages of these systems are their limited printing speed and the requirement for exact control of the shot time of the printing nozzles in relation to the axes of movement. The latter is complicated, because the movement of the print head in relation to the material to be imprinted is multi-axial.

For achieving a high printing speed, together with a simple control, a plurality of print heads can be arranged next to each other for covering the entire printing width. The movement between the print heads and the material to be imprinted is single-axial, only a movement of the material to be imprinted in the printing direction takes place. To achieve a compact arrangement of the print heads, and accordingly a high resolution, the individual print heads can be placed obliquely in relation to the printing direction and can be arranged offset from each other in the printing direction. The print points of the print heads complement each other and cover the entire width of the material to be imprinted.

To make possible a simple mounting and arrangement of the print heads, it is desirable to always fasten at least two of the print heads on a common level print head holder. However, in this connection, it is difficult to prevent distortions of the printed image and to achieve a high print quality, in particular when printing on curved material to be imprinted.

GB 2 349 607 A shows a printing device with a plurality of print heads which are arranged offset in respect to each other. These print heads are arranged inclined in the radial direction with respect to a printing cylinder.

USP 4,864,328 shows an ink jet print head with several rows of nozzles. These rows of nozzles are inclined in respect to the printing direction.

SUMMARY OF THE INVENTION

The object of the present invention is directed to providing a printing device of compact arrangement and with a high printing quality.

In accordance with the present invention, this object is attained by providing a printing device that is usable for imprinting material which are curved around a printing cylinder. The printing device has a plurality of print heads and a print head holder for supporting the print heads on a holder plane. Nozzle openings in the print heads are arranged along a row which is inclined in respect to the printing direction. The holder plane is also inclined with respect to the printing direction. The print heads are arranged on the holder so that they are substantially perpendicular with respect to the material to be imprinted.

The advantages which can be obtained by the present invention lie, in particular, in that the printing device prints at a high speed, achieves a high print quality and prevents distortions of the printed image. The print heads are inclined in relation to the holder plane in such a way that the nozzles in the print heads spray substantially vertically or perpendicularly onto the material to be imprinted. Because of the inclined arrangement of the print heads, it is possible to use a level print head holder. At the same time, the print heads can print substantially vertically on corresponding set points. Distortions of the printed image are prevented, and it is possible to achieve an outstanding print quality even at the highest printing speed.

The print heads can be inclined on the print head holder, relative to the holder plane, as a function of their distance. In particular, the inclination of the print heads is set as a function of the distance between the respective print heads and the holder center. The holder center means the section of the print head holder which is located closest to the printing cylinder and which is perpendicularly intersected by a straight diameter line through the printing cylinder. If the print heads are arranged in pairs symmetrically with respect to the holder center, the distance of the print heads from the holder center corresponds to one-half the distance of the print heads from each other, so that the inclination of the print heads can be set as a function of the distance of the print heads from each other.

In a further development of the present invention, the print heads are inclined in relation to the holder as a function of the acute angle by which the print heads, or a row of nozzles of the print head, are placed obliquely, or at which the row of print heads extends in relation to the printing direction. The obliquely placed print heads of a row are fastened on a common print head holder, so that the longitudinal direction of the print head holder corresponds to the orientation of the row, and accordingly the inclination of the print heads in relation to the print head holder is set as a function of the acute angle of the print head holder in relation to the printing direction.

To achieve a simple adjustment of the print heads in relation to the print head holder, the print heads are inclined at two different angles on two planes extending perpendicularly in respect to each other. They can be inclined, in particular, on the holder plane and on a plane perpendicularly thereto. The directions of the angles to be set are predetermined, regardless of the angle of inclination actually to be set, because of which the preconditions for mounting can be simply and precisely preset and executed.

In accordance with an advantageous embodiment of the present invention, the print heads can be inclined at a first angle on a plane which is defined by a straight connecting line through the print heads on the respective print head holder and the straight diameter line through the printing cylinder, which intersects this straight connecting line. Thus the first angle is located on a plane which contains the longitudinal direction of the print head holder and which cuts an ellipse out of the printing cylinder. In this case, the first angle of each print head is selected in such a way that the spraying direction of the respective print head extends perpendicularly on a tangent line at a set point against the ellipse which is cut out of the printing cylinder by the plane.

In a further development of the present invention, the print heads are each inclined relative to the holder plane at a second angle on a plane which extends perpendicularly in respect to the straight connecting line through the print heads which are mounted on a print head holder, and which also extends through the respective print head. Thus the second angle lies on a plane perpendicularly in respect to the holder plane.

To be able to imprint a respectively wide material to be imprinted over its entire width, and without displacing the print heads transversely to the printing direction, a plurality of print head holders are arranged parallel with each other, each of which print head holders supports a plurality of obliquely placed print heads. The inclination of the print heads in relation to each print head holder is set in the manner previously described.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
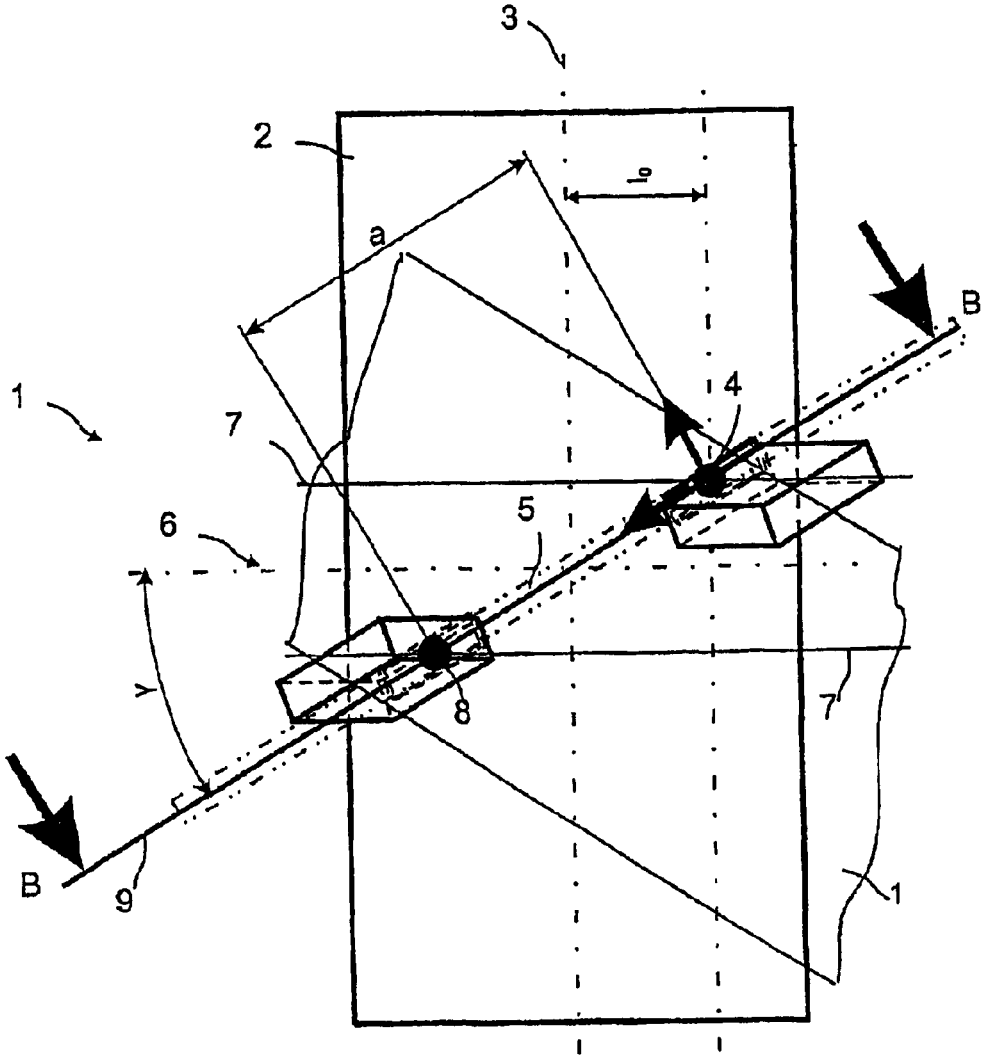
FIG. 1, a top plan view of a printing device in accordance with the present invention and with a printing cylinder, a print head holder and with two print heads seated thereon in a schematic representation, FIG. 2, a sectional view taken along the line B—B in FIG. 1, FIG. 3, a side elevation view of the printing device, taken in a direction of view parallel with the longitudinal extension of the print head holder, and in FIG. 4, a front view of the printing device taken in a direction of view parallel with the axis of rotation of the printing cylinder.

Referring initially to FIG. 1, there may be seen a printing device, generally at 1, in accordance with the present invention. The printing device 1 comprises a printing cylinder 2, which is supported for rotation around its longitudinal axis 3. The material to be imprinted moves around the printing cylinder 2 and is curved corresponding to the printing cylinder 2. Paper or the like can be provided as the material to be imprinted, so that printing, by operation of the printing device 1, takes place directly on the material to be imprinted. The printing device 1 can also be utilized for placing images on printing plates which are then used for offset printing. In this latter case, a printing plate is mounted on the printing cylinder 2. Initially, an image is placed on the printing plate by utilization of the printing device 1 in order to perform printing using the printing plate.

The printing device 1 has a plurality of print heads 4 as the printing group, which operate in accordance with the ink jet principle and which include rows of nozzles that spray a stream or small droplets on the material to be imprinted. For reasons of clarity, only two print heads 4 are represented in the drawings, which two print heads 4 are fastened on a common print head holder 5, which print head holder 5 is depicted in dot-dash lines in FIGS. 1–4. It is, of course, understood that a plurality of print heads 4 are fastened on the print head holder 5, or on several such print head holder 5, next to each other and extending transversely to a printing direction 6. The print areas of the individual print heads 4 complement each other and cooperate to cover the entire width of the material to be imprinted.

In the depicted preferred embodiment, two print heads 4 are arranged on the print head holder 5. The print head holder 5 is embodied to be level and defines a holder plane B—B, in which all of the print heads 4 seated on the print holder 5 are arranged. As shown in FIG. 1, the print heads 4 are obliquely placed. They are each oriented at an acute angle $\gamma$ in respect to the printing direction 6, so that they can be arranged more densely and to achieve a higher resolution of the printed image. Corresponding to the oblique placement of the print heads 4, the print head holder 5 extends, in its longitudinal direction, at the same angle $\gamma$ in respect to the printing direction 6 in order to be able to seat both print heads 4, as may be seen most clearly in FIG. 1.

The print heads 4 are arranged symmetrically with respect to a holder center of the print head holder 5, i.e. they are each spaced apart at the same distance from the holder center of the print head holder 5. In this case, the holder center of the print head holder 5 is defined as the point on the print head holder 5 which lies closest to the printing cylinder 2. This point is, in turn, defined in that a radius R, or a straight diameter line of the printing cylinder 2 through the holder center, extends perpendicularly to the print head holder 5. As shown in FIG. 1, the print heads 4 are spaced apart from each other by the distance a, accordingly, the distance of each of the print heads 4 from the holder center is ½a.

The print heads 4 are each inclined, in relation to the print head holder 5, so that each print head spray axis 7 is oriented substantially perpendicularly on a set point 8 of the printing cylinder 2 and each print head 4 accordingly sprays vertically onto the material to be imprinted. In this case, the two print heads 4 are inclined at two different angles in relation to the print head holder 5, which are located on planes which extend vertically to each other.

Figure 2:
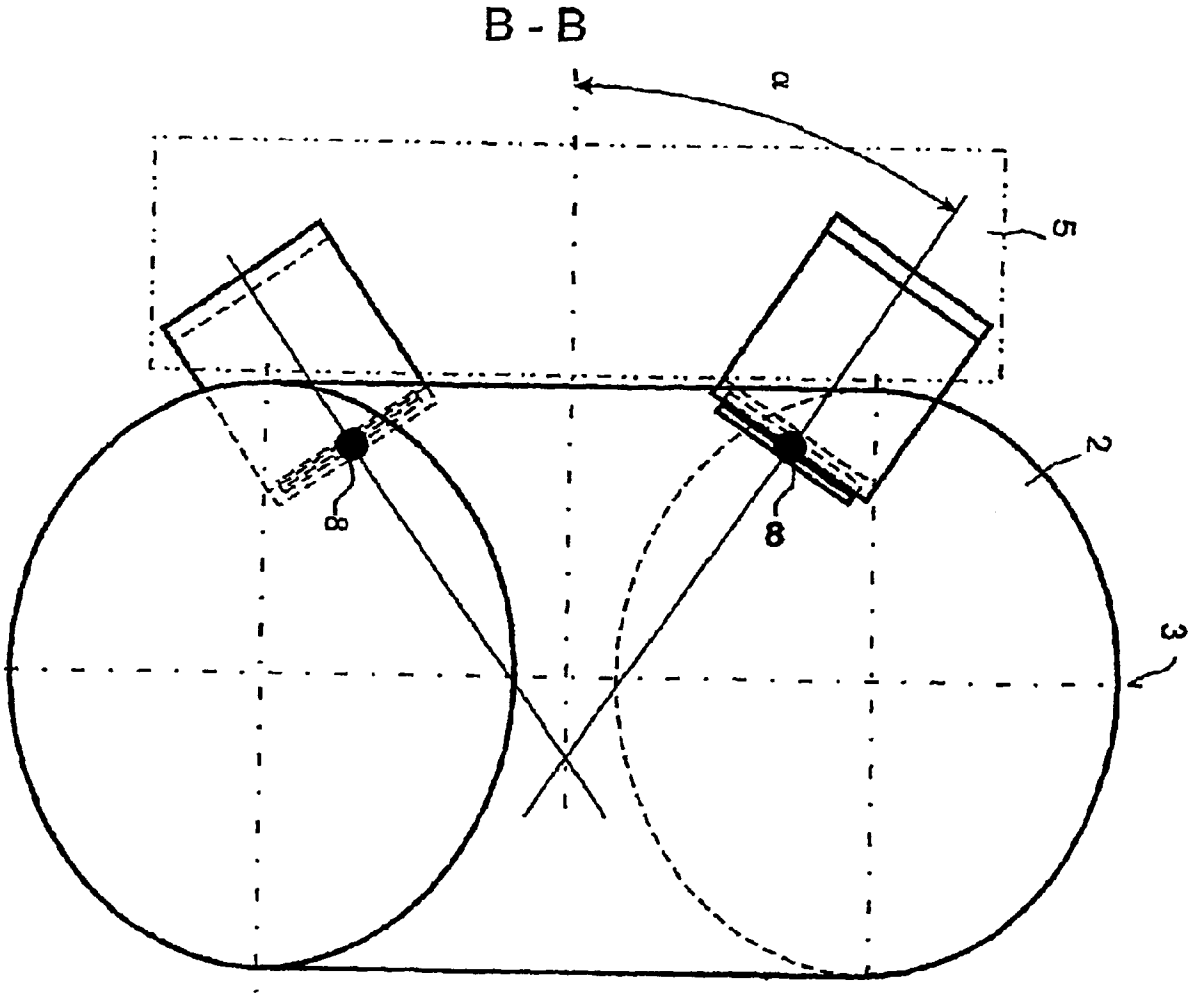
Figure 3:
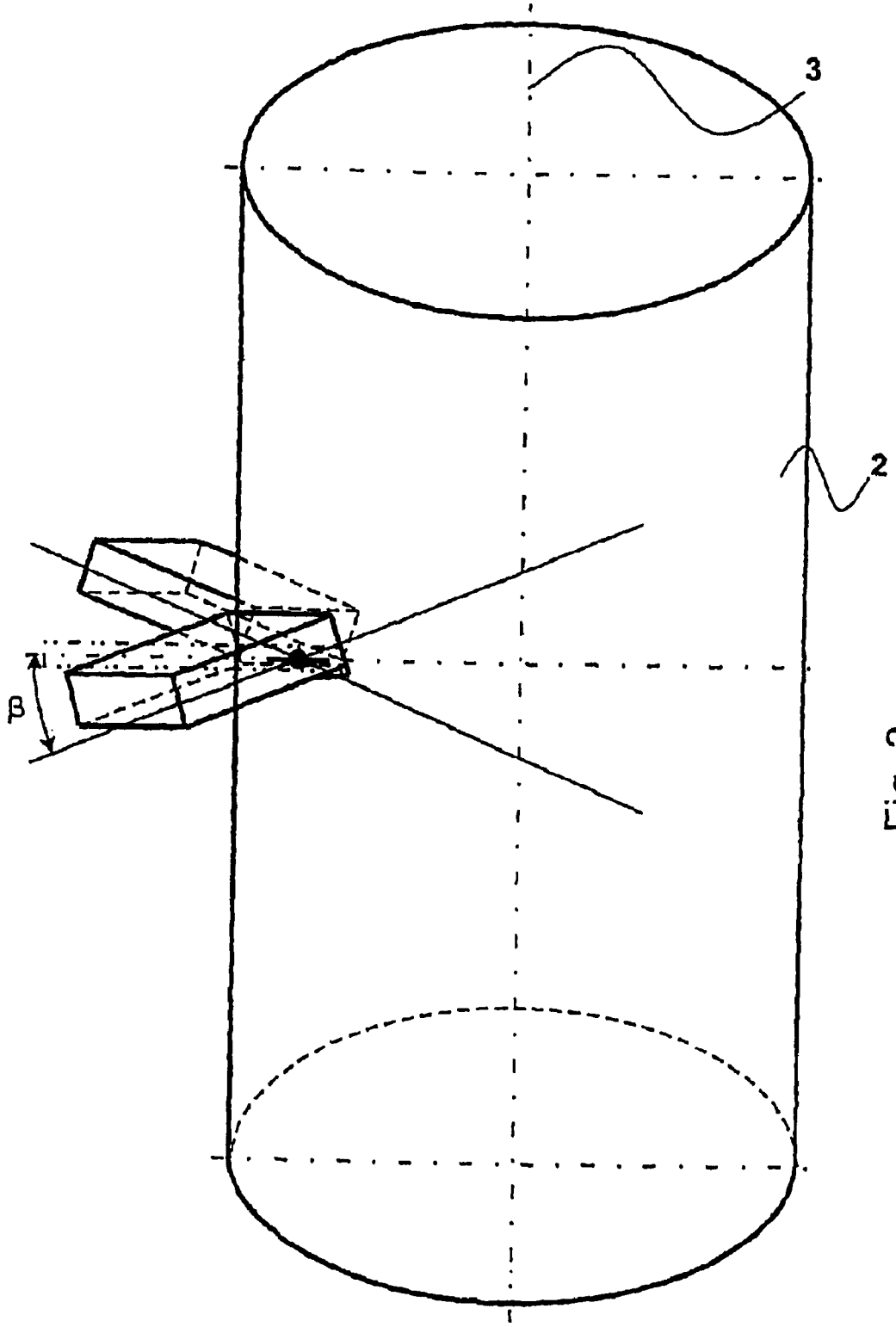

A first angle $\alpha$, as seen in FIG. 2, and at which the print heads 4 are inclined relative to the print head holder 5, is located on the holder plane B—B, which is constituted, for one, by the longitudinal direction of the print head holder 5, or by a straight connection line 9 through the print heads 4, and furthermore by the straight diameter line passing through the holder center of the print head holder 5 and extending perpendicularly in respect to it. The holder plane B—B lies in the drawing plane in which FIG. 2 lies.

Figure 4:
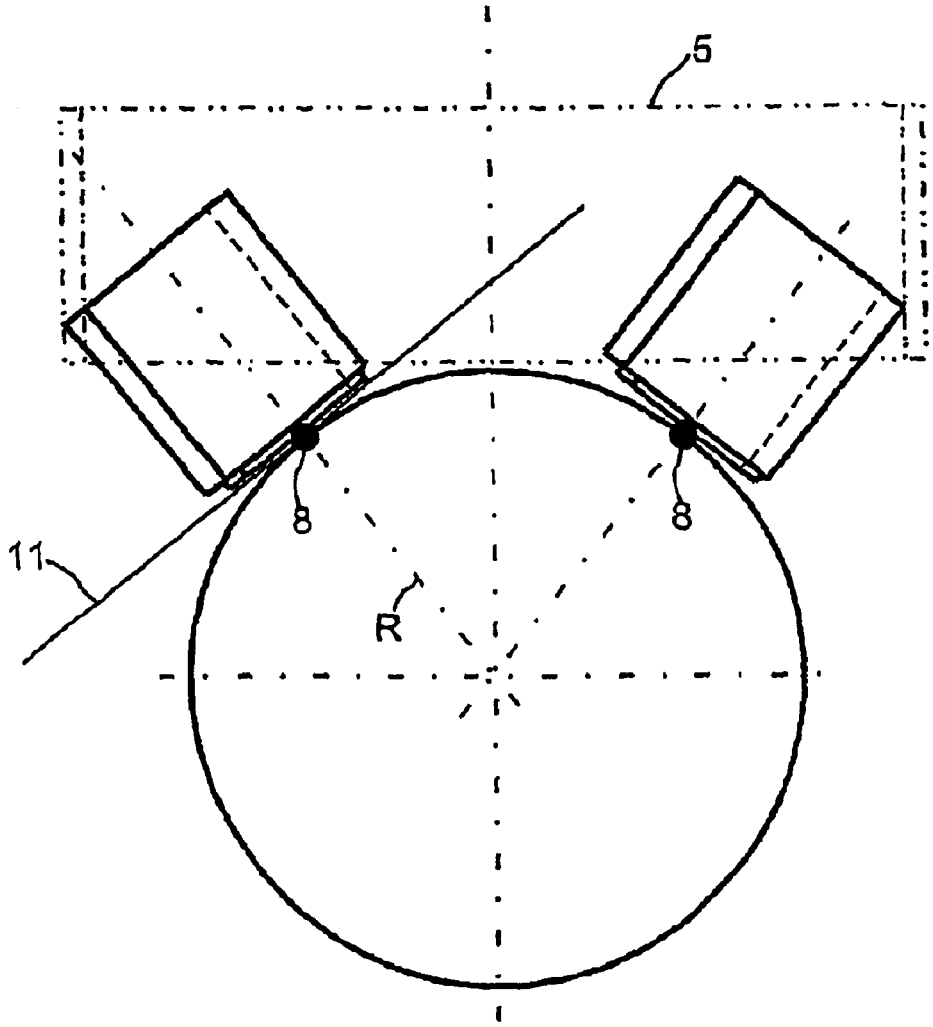

The holder plane B—B defines an ellipse 10 as it cuts through the printing cylinder 2, which ellipse 10 can be seen in FIG. 2, since the holder plane B—B is inclined at the angle $\gamma$, or $90°-\gamma$, to the longitudinal axis 3 of the printing cylinder 2. The print heads 4 are inclined relative to the print head holder 5 at the angle $\alpha$, so that each sprays on its assigned set point 8 on the printing cylinder 2. In this case, the angle $\alpha$ that the spray axis 7 of the respective print head 4 is oriented perpendicularly with respect to a tangent line or plane 11 passing through the respective set point 8, as seen in FIG. 4. In the section B—B in accordance with FIG. 2, the tangent line appears as a tangent line on the ellipse 10 through the set point 8. The print head 4 is oriented vertically on this line.

The angle of inclination $\alpha$ in the holder plane B—B in relation to the print head holder 5 is determined here in the following manner.

alpha=arctan(cos(gamma)• tan(psi), wherein psi=arcsin($X_i$• cos(gamma))/R, wherein $X_i$R•sin(phi)/cos(gamma), wherein phy=$1_0$•(360/2R pi), wherein $1_0$=a/2•cos(gamma), with a=the distance of the print heads from each other, and R=radius of the print cylinder 2.

The angle of inclination $\gamma$ of the print heads 4 in respect to the printing direction 6 is 31°, for example, The radius of the printing cylinder 2 is 181 mm, for example, and the distance a of the print heads 4 on the print head holder 5 is, for example, 52.66 mm. In this case the print head 4 is inclined at an angle $\alpha$ of 6.03°.

In addition to the inclination at the angle $\alpha$, each print head 4 is inclined at a second angle $\beta$ relative to the print head holder 6 in order to prevent, as much as possible, the distortion of the printed image in spite of the curvature of the printed image. The angle $\beta$ lies on a plane which extends perpendicularly in respect to the holder plane B—B. The plane on which the angle $\beta$ lies, extending perpendicularly to the holder plane B—B, extends, in particular, perpendicularly to the longitudinal direction of the print holder head 5, or to the straight connecting line 9 through the print heads 4. The reference point of $\beta$ is located in the plane, the print head is located outside the plane, i.e. the angle $\beta$ represented is distorted by the angle $\alpha$. The plane of the angle $\beta$ is the plane in FIG. 3.

The angle $\beta$ is determined so that the spray axis 7 of the respective print head 4 is oriented substantially perpendicularly on the tangent plane 11 at the print cylinder 2 through the respective set point 8. The angle of inclination $\beta$, of the print head 4 is, in particular, determined in the following manner:

beta=arcsin(sin(phi)•sin(gamma)), wherein phi=$1_0$•(360/2R pi), wherein $1_0$=a/2•cos(gamma), with a=distance of the print heads from each other, and R=radius of the printing cylinder 2.

With the values for $\gamma$, R and "a" given above, the angle $\beta$ is 3.61°.

Inclination setting devices are arranged between the print heads 4 and the print head holder 5 for setting the two inclination angles $\alpha$ and $\beta$, which inclination setting devices can be integrated into the supports of the print heads 4 on the print head holder 5. The inclination setting devices, which are not specifically shown in the drawings, are preferably embodied in two axes, i.e. they can only be moved, or set, on the two planes in which the angles $\alpha$ and $\beta$ are located. In principle, ball-headed bearings or the like would be usable. However, an inclination setting device with separate setting axes has the advantage that the two inclination angles $\alpha$, $\beta$ can be set independently of each other, so that the mounting, or adjustment, is correspondingly simplified.

With the above-described printing device 1, only the material to be imprinted is moved during the printing process. The print heads 4 need not be moved transversely to the printing direction 6. It is nevertheless possible by use of the above-described printing device 1 to achieve an outstanding and distortion-free printed image at the highest printing speed.

This printing device 1, in accordance with the present invention is usable to apply a spray of liquid for changing the coating of a printing forme, in particular the coating of a planographic printing forme of a printing press. It is also possible to use the subject printing device to apply an additional coating to a printing forme. The properties of this additional coating can be changed.

While a preferred embodiment of a printing device in accordance with the present invention has been set forth fully and completely hereinabove, it will be apparent to one of skill in the art that various changes in, for example the type of print heads used, the structure of the print head holder, and the like could be made without departing from the true spirit and scope of the present invention which is accordingly to be limited only by the following claims.

What is claimed is:

1. A printing device adapted to imprint materials to be imprinted moving in a printing direction and curved around a printing cylinder, said printing device comprising:

a plurality of print heads;

a print head holder having a holder center, said plurality of print heads being supported symmetrically on said print head holder with respect to said holder center;

a plurality of nozzle openings in each said print head, said plurality of nozzle openings in each said print head arranged in a row, each said row being inclined at an angle to the printing direction;

a printing cylinder axis of rotation;

a holder plane defined by said print head holder, said holder plane being inclined at an acute angle to the printing direction; and a line extending in a radial direction of the printing cylinder with respect to said printing cylinder axis of rotation and extending perpendicularly to the printing direction, said line contacting said holder center, each of said print heads being inclined at an angle $\alpha$ with respect to said radial direction and each being oriented perpendicularly to the material to be imprinted.

2. The printing device of claim 1 wherein each of said plurality of print heads is supported on said print head holder at a spacing distance and is inclined on said print head holder as a function of said spacing distance.

3. The printing device of claim 1 wherein said symmetrically spaced print heads are each inclined at an acute angle.

4. The printing device of claim 1 wherein said symmetrically spaced print heads are inclined in first and second planes extending perpendicularly to each other.

5. The printing device of claim 1 wherein said angle $\alpha$ is defined by:

tan($\alpha$)=(cos($\gamma$))•tan($\Psi$), wherein $\Psi$=arcsin($X_i$•cos($\gamma$))/R, wherein $X_i$=R•sin($\Psi$)/cos$\gamma$), wherein $\phi$=$1_0$•(360/2R$\pi$), wherein $1_0$=a/2•cos($\gamma$), with a distance of the print heads from each other, and R=radius of the print cylinder.

6. The printing device of claim 1 further including a plurality of said print head holders, said plurality of print head holders being arranged parallel with each other and each supporting a plurality of said print heads.

7. The printing device of claim 1 wherein the material to be imprinted is a printing forme and said print heads apply one of a coating and a means for changing a coating to said printing forme.

8. The printing device of claim 7 wherein said printing forme is a planographic printing plate.

9. A printing device adapted to imprint materials to be imprinted moving in a printing direction and curved around a printing cylinder. said printing device comprising:

a plurality of print heads:

a print head holder having a holder center, said plurality of print heads being supported symmetrically on said print head holder with respect to said holder center;

a plurality of nozzle openings in each said print head, said plurality of nozzle openings in each said print head arranged in a row, each said row being inclined at an angle to the printing direction;

a printing cylinder axis of rotation;

a holder plane defined by said print head holder, said holder plane being inclined at an acute angle to the printing direction; and a line extending in a radial direction of the printing cylinder with respect to said printing cylinder axis of rotation and extending perpendicularly to the printing direction, said line contacting said holder center, said plurality of print heads being inclined at an angle β with respect to said holder plane and being oriented perpendicularly to the material to be imprinted.

10. The printing device of claim 9 wherein said angle β is defined by:

$\beta=\arcsin(\sin(\phi)\bullet\sin(\gamma))$, wherein $\phi=1_0\bullet(360/2R\pi O$, wherein $1_0=a/2\bullet\mathrm{Cos}(\gamma)$, with a=distance of the print heads from each other, and R=radius of the printing cylinder.

* * * * *